US007254894B1

(12) United States Patent
Halpert

(10) Patent No.: US 7,254,894 B1
(45) Date of Patent: Aug. 14, 2007

(54) METHOD OF CUTTING AND INSTALLATION OF BUILDING BOARDS

(76) Inventor: Henry Halpert, 1735 57th St., Brooklyn, NY (US) 11204

( * ) Notice: Subject to any disclaimer, the term of this patent is extended or adjusted under 35 U.S.C. 154(b) by 0 days.

(21) Appl. No.: 11/405,711

(22) Filed: Apr. 18, 2006

(51) Int. Cl.
*E04B 1/00* (2006.01)

(52) U.S. Cl. ..... 33/1 B; 52/98; 52/105

(58) Field of Classification Search ..... 33/1 B, 33/1 F, 1 G, 411, 526, 527, DIG. 11; 428/43, 428/136; 52/98, 100, 105
See application file for complete search history.

(56) References Cited

U.S. PATENT DOCUMENTS 4,150,184 A * 4/1979 Tesch ..... 428/43
4,858,402 A * 8/1989 Putz ..... 52/105
5,358,757 A * 10/1994 Robinette et al. ..... 428/43
5,390,458 A * 2/1995 Menchetti ..... 52/417
6,012,255 A * 1/2000 Smid et al. ..... 52/105
6,235,365 B1 * 5/2001 Schaughency et al. ..... 428/40.1
6,383,594 B2 * 5/2002 Weinstein et al. ..... 428/43
6,743,326 B2 * 6/2004 Bogrett et al. ..... 156/268
6,760,978 B2 * 7/2004 Gleeson ..... 33/563
6,848,220 B2 * 2/2005 Faurholdt et al. ..... 52/58
6,880,299 B2 * 4/2005 Martin ..... 52/105
RE38,783 E * 8/2005 Harris ..... 33/494
6,935,080 B2 * 8/2005 Allwein et al. ..... 52/404.1

* cited by examiner

*Primary Examiner*—R. Alexander Smith

(57) ABSTRACT

A building board such as a gypsum board is provided for use in construction of commercial and residential building the board having opposed parallel surfaces, one having spaced apart transverse markings and the other having spaced apart longitudinal markings. Each marking is associated with a string embedded therein, and a releasable paper layer is coextensively adhered to each surface of the board adapted to be peeled away from the surface when the cord is pulled to peel away the releasable paper, and the desired size board is cut by breaking the board along the markings.

16 Claims, 2 Drawing Sheets

METHOD OF CUTTING AND INSTALLATION OF BUILDING BOARDS

FIELD OF THE INVENTION

The present invention relates generally to building boards for use in building construction and is particularly related to building boards such as gypsum wallboards and ceiling tiles for residential and commercial construction. More particularly, the present invention is related to method of providing gypsum boards having unique markings with associated cords designed to insure dimensional precessions which make such boards ready and simple to install during construction.

BACKGROUND OF THE INVENTION

Gypsum wallboard, also known as sheetrock and plasterboard, is a widely used material of construction, both for residential as well as commercial buildings. Indeed the manufacture of gypsum wallboards and their use in building construction have been described in several prior art patents. For example, as disclosed in U.S. Pat. No. 4,858,402, issued Aug. 22, 1989, according to the prior art gypsum boards are made in large quantities and are sold in standardized sizes. Before installation, they must be cut to precise sizes and dimensions and marked to indicate fixing points for the receiving nails, studs or other fasteners. For more efficient installation of these boards, the aforementioned patent describes a method of applying to the board markings in the form of paints which fade by exposure to light. These markings facilitate cutting of the board, placing and fastening them to construct wall. The markings will eventually fade so that the wall can be painted without visible indication of the markings.

U.S. Pat. No. 6,760,978 issued Jul. 13, 2004 discloses building sheets having a plurality of surface grooves to facilitate cutting the sheet along the grooves.

In a more recent patent, i.e., U.S. Pat. No. 6,880,299 issued Apr. 19, 2005, there is described a drywall having sets of indicia which indicate the relative positions of wall supports.

The methods described by the prior art have not been entirely satisfactory. They are generally time consuming, results in unevenly cut boards and are costly to install.

Therefore, it is an object of the present invention to provide a method for making wallboards and ceiling tiles which are efficient and less time consuming to install during construction.

It is also an object of this invention to provide a simple and effective method of providing gypsum boards which are cut to precise sizes and dimensions.

It is a further object of this invention to provide prefabricated wallboards, such as gypsum boards and ceiling tiles which are simple and ready to install in the construction of commercial and residential buildings.

The foregoing and other advantageous features of the present invention will be more fully appreciated from the following detailed description and the corresponding drawings.

SUMMARY OF THE INVENTION

The present invention provides a method of making building boards such as gypsum board having a desired size and precise dimensions which make them simple and economical to install in construction of commercial and residential buildings. A large slab or web of a gypsum board is marked on both its major surfaces with markings which are formed transversely on one surface and longitudinally on the opposed parallel surface. The markings are formed in the positions at which the board is to be cut or broken to that size. A cord or a string is embedded along each marking and may project beyond the edges of the board. A releasable liner such as a releasable paper is coextensively adhered to each surface and is adapted to be peeled away from its respective surface by pulling up and away of the string along its associated marking.

BRIEF DESCRIPTION OF THE DRAWINGS

In the drawings wherein like reference numerals are employed to designate like parts.

DETAILED DESCRIPTION OF THE INVENTION

Figure 1:
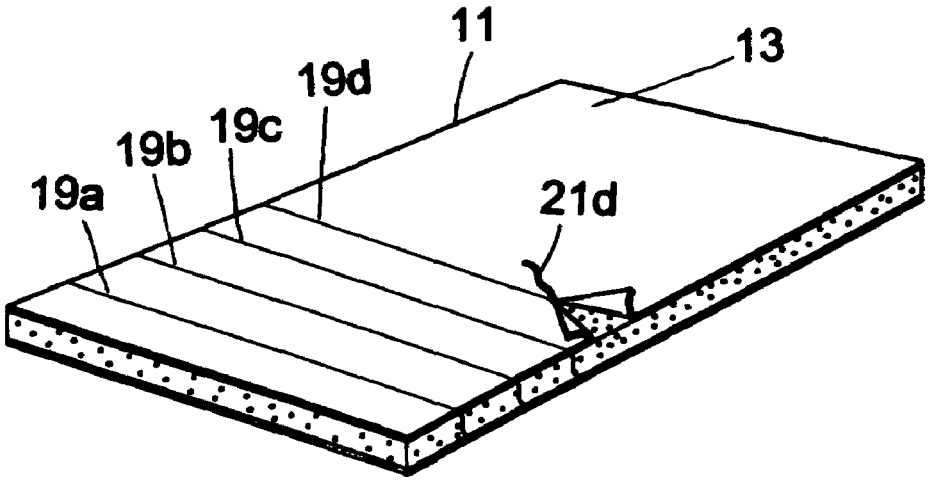
FIG. 1 is a perspective view of a building board made according to the present invention.
Figure 4:
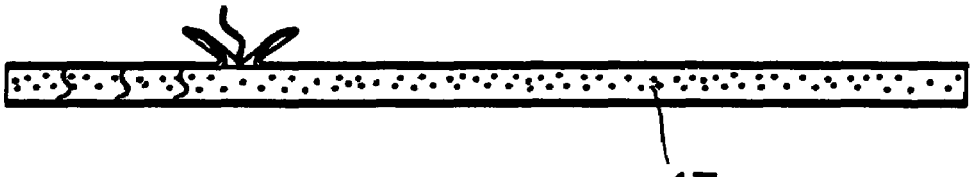
FIG. 4 is an edge view of the building board.
Figure 2:
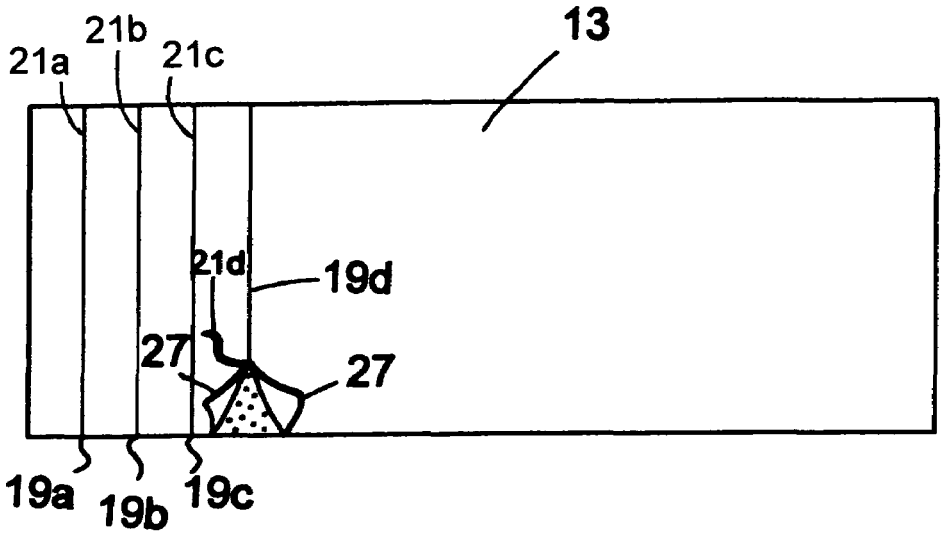
FIG. 2 is a view of the top of the building board shown in FIG. 1 with traverse markings and the release paper peeled away.
Figure 3:
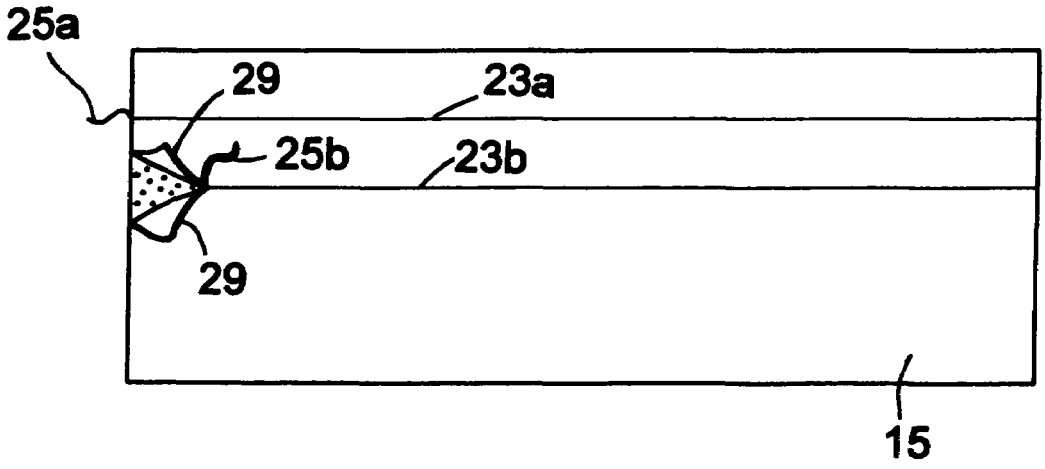
FIG. 3 is a view of the bottom of the building board shown in FIG. 1 with longitudinal markings and the release paper pulled away.

Referring to FIGS. 1-4 there are shown a building board 11 which may be a gypsum board cut from a large slab shown in rectangular form although it may be square-shaped as well. The gypsum board 11 is defined by the opposed spaced apart surfaces 13 (see FIG. 2) and 15 (see FIG. 3) and intermediate edge 17. For convenience of description the surfaces 13 and 15 may be referred to as top and bottom surfaces, respectively. The top surface 13 has a plurality of spaced apart transverse markings spanning the length of the top web surface 13. For the sake of simplicity in illustration such markings are shown designated as 19*a*, 19*b*, 19*c*, 19*d* in FIG. 2. Although these markings are shown spaced apart equally, they may be formed at any desired distance such as ¼ inch, 2 inch, 6 inch positions, etc., as may be desired. Each of these markings has associated therewith a string or cord such as the strings 21*a*, 21*b*, 21*c*, 21*d* with only string 21*d* being visible in FIG. 2. Similar spaced markings are provided on the other surface 15 in the longitudinal direction as designated by 23*a*, 23*b*, etc. with associated strings or cords such as the strings 25*a*, 25*b*, with only the string 25*b* being visible as shown in FIG. 3.

The top surface 13 and the bottom surface 15 is each covered coextensively with a layer of an adherent liner such as a releasable paper 27 adhered to the top surface 13 and releasable paper 29 adhered to the bottom surface 15. As shown in FIGS. 2 and 3, the cords may extend beyond the edges of the top and bottom surfaces so that they can be gripped by the fingers and pulled. Thus, pulling the cord 21*d* upward causes the releasable paper 27 to be peeled away. Although FIG. 2 illustrates partial peeling of the releasable liner, the cord can be pulled away as far as it is desired so that the board can be cut, i.e., broken by the hands at the desired position to obtain a gypsum board of the precise desired dimensions. Similar procedure is followed when it is desired to cut the gypsum board in the longitudinal direction. Although in FIGS. 2 and 3, the releasable paper is shown peeled away symmetrically, in reality, the paper may be peeled away to a greater extent to one side or another.

From the foregoing description and the drawings the advantages of the present invention become readily apparent. It eliminates the need for marking the location of the cut, eliminates the need to score the releasable liner with a knife and eliminates the need for marking the location of the fasteners, and it is therefore much easier and simpler to install the boards. The provision of embedded cords also results in stronger board thus permitting the use of thinner board than the thick boards now used in the construction.

It can also be appreciated from the foregoing description that a variety of cords or synthetic fibers may be used, and suitable polymeric sheets with adhesive surface can be employed as the releasable paper. All these and other variations and modifications are obvious from the foregoing description and are therefore within the contemplation of this invention.

The invention claimed is:

1. A method of providing building boards with predetermined size and precise dimensions for use in the construction of commercial and residential buildings, which method comprises using a prefabricated board of specified thickness defined by spaced apart opposed parallel surfaces, placing a cord or a string at predetermined spaced apart distances along each of said surfaces, adhering a sheet liner coextensively on each surface of said board, one of said sheet liners having spaced apart transverse markings and the other one of said sheet liners having spaced apart longitudinal markings, each cord or string being associated with each of said markings, pulling each of said cords or strings thereby cutting said sheet liner along its associated marking thereby facilitating breaking of said fabricated board to a predetermined size.

2. A method as in claim 1 wherein each of said cords is embedded in its respective associated marking.

3. A method as in claim 1 wherein said building board is a gypsum board.

4. A method as in claim 2 wherein said building board is a gypsum board.

5. A method as in claim 1 wherein said sheet liner is a paper layer.

6. A method as in claim 2 wherein said sheet liner is a paper layer.

7. A method as in claim 3 wherein said sheet liner is a paper layer.

8. A method as in claim 4 wherein said sheet liner is a paper layer.

9. A building board of precise dimensions for use in the construction of commercial and residential buildings, said board having a finite thickness and defined by spaced apart opposed parallel surfaces, a layer of a sheet liner coextensively adhered to each surface of said board, one of said sheet liners having spaced apart transverse markings and the other one of said sheet liners having spaced apart longitudinal markings, a cord or a string associated with each marking embedded beneath each of said layers adapted to be pulled from its respective surface of said board to thereby cut said layer away from its respective surface expose said surface and break the board at said cut layer.

10. A building board as in claim 9 wherein each of said cords is embedded beneath its respective associated marking.

11. A building board as in claim 9 wherein said building board is a gypsum board.

12. A building board as in claim 10 wherein said building board is a gypsum board.

13. A building board as in claim 9 wherein said layer is a paper layer.

14. A building board as in claim 10 wherein said layer is a paper layer.

15. A building board as in claim 11 wherein said layer is a paper layer.

16. A building board as in claim 12 wherein said layer is a paper layer.

* * * * *